US006550142B1

(12) United States Patent
Moser

(10) Patent No.: US 6,550,142 B1
(45) Date of Patent: Apr. 22, 2003

(54) HAND TOOL WITH RETRACTABLE IMPLEMENT

(75) Inventor: Rocky Lee Moser, Exeter, CA (US)

(73) Assignee: Taylor Cutlery, Kingsport, TN (US)

( * ) Notice: Subject to any disclaimer, the term of this patent is extended or adjusted under 35 U.S.C. 154(b) by 0 days.

(21) Appl. No.: 09/973,092

(22) Filed: Oct. 9, 2001

(51) Int. Cl.[7] ..... B26B 3/06
(52) U.S. Cl. ..... 30/153; 7/118; 81/427.5
(58) Field of Search ..... 30/153; 7/118, 7/119, 120; 403/61; 81/427.5

(56) References Cited

U.S. PATENT DOCUMENTS

| | | | | | |
|---|---|---|---|---|---|
| 229,706 | A | * | 7/1880 | Jansen | 30/153 |
| 365,086 | A | * | 6/1887 | Miller | 30/153 |
| 447,185 | A | * | 2/1891 | Hollweg | 30/153 |
| 508,273 | A | * | 11/1893 | Brauch | 30/153 |
| 847,206 | A | * | 3/1907 | Saunderson | 30/153 |
| 881,294 | A | * | 3/1908 | Billings | 30/153 |
| 1,549,545 | A | * | 8/1925 | Hickman | 30/153 |
| 1,665,955 | A | * | 4/1928 | Gatewood | 30/153 |
| D154,482 | S | * | 7/1949 | Hill | 30/144 |
| 2,714,249 | A | * | 8/1955 | Clark et al. | 30/153 |
| 3,191,648 | A | * | 6/1965 | Dustrude | 30/153 |
| 4,330,937 | A | * | 5/1982 | Cope | 30/153 |
| 4,364,174 | A | * | 12/1982 | De Asis | 30/153 |
| 4,547,965 | A | * | 10/1985 | Moore | 30/153 |
| 4,648,145 | A | * | 3/1987 | Miceli | 30/153 |
| 4,669,140 | A | * | 6/1987 | Miceli | 30/153 |
| 4,672,743 | A | * | 6/1987 | Grahm | 30/153 |
| 4,722,140 | A | * | 2/1988 | Miceli | 30/153 |
| 4,730,393 | A | * | 3/1988 | Coburn | 30/153 |
| 5,657,543 | A | * | 8/1997 | Collins | 30/123 |
| 5,794,345 | A | * | 8/1998 | Ryon et al. | 30/153 |
| 6,003,180 | A | * | 12/1999 | Frazer | 7/128 |
| D420,884 | S | * | 2/2000 | Zaha | D8/99 |
| 6,170,158 | B1 | * | 1/2001 | Daily | 30/155 |
| 6,195,898 | B1 | * | 3/2001 | Lemisch | 30/153 |
| 6,434,834 | B2 | * | 8/2002 | DiMatteo et al. | 30/192 |

* cited by examiner

*Primary Examiner*—Allan N. Shoap
*Assistant Examiner*—Jason Prone
(74) *Attorney, Agent, or Firm*—Stevens, Davis, Miller & Mosher, LLP

(57) ABSTRACT

A hand tool generally including a base member; an implement displaceable along a line of travel intersecting the base member; a pair of handle segments each having an end pivotally connected to the base member to a side of the line of travel; and a pair of actuating links each having an end pivotally connected to the implement and an opposite end pivotally connected to a handle segment at a point disposed between ends of the connected handle segment whereby upon pivoting the handle segments about their pivotal connections with the base member, the actuating links will be caused to displace the implement along its line of travel.

36 Claims, 3 Drawing Sheets

HAND TOOL WITH RETRACTABLE IMPLEMENT

This invention relates to a hand tool and more particularly to a hand tool provided with an implement such as a knife, screwdriver, saw and the like and a pair of handle segments which may be manipulated to extend the implement to an open position with the handle segments aligned therewith to provide a gripping means for the tool, and to retract the implement to a closed position with the handle segments enclosing the implement.

BACKGROUND OF THE INVENTION

In the prior art, there are a great number of hand tools provided with implements such as knives, screwdrivers, saws and the like, and a pair of handle segments in which the handle segments may be manipulated to provide a gripping means for the user to facilitate the use of the implement, and further manipulated to enclose the implement to facilitate the handling of the tool when not in use. Often, with such tools in their closed or collapsed condition, it is desirable to carry them on the person of the user. Such prior art hand tools, however, have not been found to be neatly compact in their closed or collapsed condition, easily manipulated between their closed and opened positions and aesthetic in appearance. Accordingly, it is the principal object of the present invention to provide such a hand tool which is neatly compact in a closed condition to facilitate the carrying of the tool on the attire of the user, easily manipulated between closed and opened positions and provides a pleasing appearance to a consumer.

SUMMARY OF THE INVENTION

The present invention provides a hand tool neatly compact in a closed or collapsed condition, easily manipulated between opened and closed conditions and aesthetic in appearance, generally consisting of a pair of handle segments operatively connected together for pivotal movement relative to each other about a first axis; an implement disposable along a line of travel supported by such handle segments; and a pair of support links, each having an end operatively connected to the implement for pivotal movement about a second axis and pivotally connected at another end thereof to a handle segment at a point disposed between the ends of such handle segment whereby upon pivoting the handle segments relative to each other about such first axis, the support links will be caused to displace the implement along such line of travel. In pivoting such handle segments about such first axis to displace the implement along its line of travel, such links operate to extend the blade to an open position aligned with the handle sections and to a retracted position between such handle segments. Preferably, when the implement is disposed in its closed or retracted position between the handle segments, both the implement and the support links are received within opposed openings in the handle segments to enclose them.

DESCRIPTION OF THE PREFERRED EMBODIMENTS OF THE INVENTION

Figure 1:
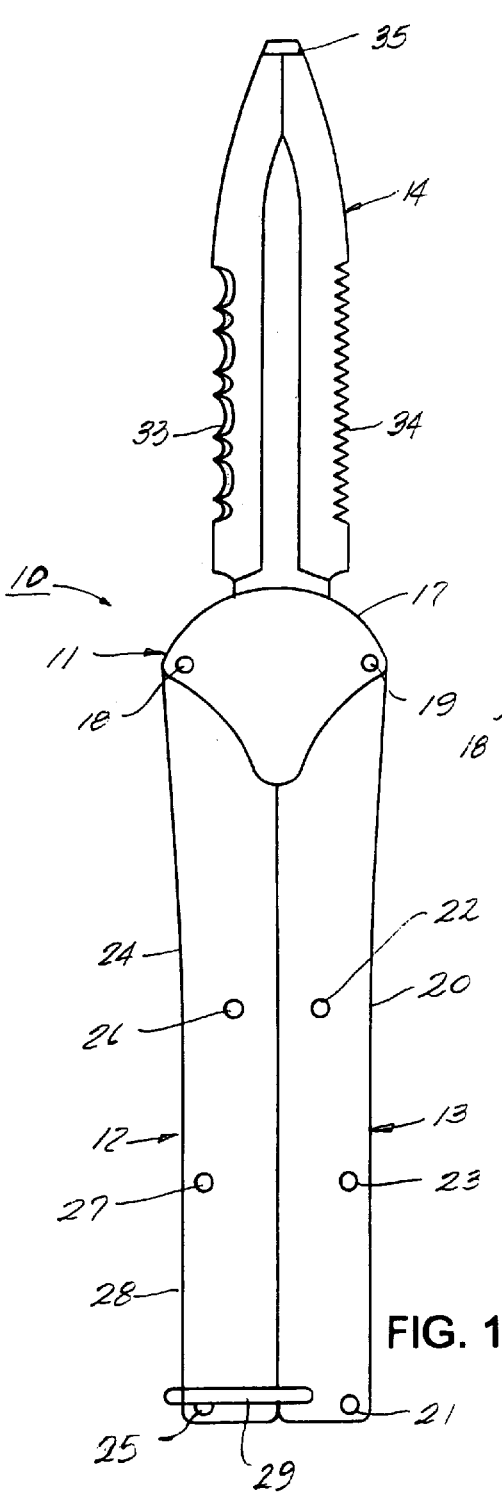
FIG. 1 is a side elevational view of a hand tool embodying the present invention, provided with an implement shown in an extended or operative position.
Figure 2:
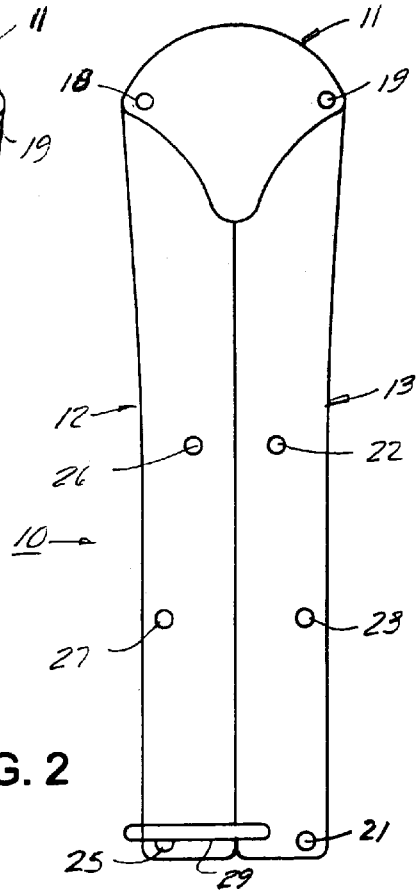
FIG. 2 is a side elevational view of the embodiment shown in FIG. 1, in which the implement thereof has been retracted and enclosed within a pair of handle segments.

Referring to FIGS. 1 through 5 of the drawings, there is illustrated a hand tool 10 embodying the present invention. Generally, the tool consists of a base member 11, a pair of handle segments 12 and 13, an implement 14 and a pair of actuating links 15 and 16. Base member 11 consists of a pair of identically configured plate sections 17, 17 spaced apart and secured together by a pair of spaced pins 18 and 19. Handle segments 12 and 13 are identically configured and are pivotally connected to the base member, each for pivotal movement within an arc of about 45° as illustrated in phantom lines in FIGS. 3 and 4. Handle segment 13 consists of a pair of elongated, spaced apart plate sections 20, 20 pivotally connected at one set of ends thereof to pin 19, secured together at an opposite end thereof by a pin 21, provided with a pivot pin 22 disposed substantially at a midpoint between the ends of plate sections 20, 20 and spanning such sections, and a stop pin 23 disposed between pins 21 and 22, adjacent outer edges of plate sections 20, 20 and spanning such sections. Handle segment 12 is essentially a mirror image of handle segment 13 including a pair of elongated, spaced apart plate sections 24, 24 pivotally connected at one set of ends to pin 18, connected together at an opposite set of ends by means of a pin 25, provided with a pivot pin 26 between the ends thereof and spanning the plate sections and a stop pin 27 between pins 25 and 26, disposed adjacent a set of outer edges 28, 28 and spanning the plate sections. The set of ends of handle segments 12 and 13 pivotally connected to the base member are received within the space between plate sections 17, 17, and the plate sections adapted to be positioned in side by side relation as shown in FIGS. 1 and 2, lie in the same planes with the inner edges thereof disposed in abutting relation. The handle sections are adapted to be detachably secured together as shown in FIGS. 1 and 2 by means of a substantially U-shaped latch 29 pivotally connected at the free ends thereof to end portions of plate sections 20, 20, and adapted to be pivoted to receive an end of handle segment 12 as shown in FIGS. 1 and 2 to detachably secure the free ends of handle segments 12 and 13 together. The handle segments may be unlatched merely by engaging the bight portion of the latch with a finger or thumb and pivoting the latch free of handle segment 12.

Figure 3:
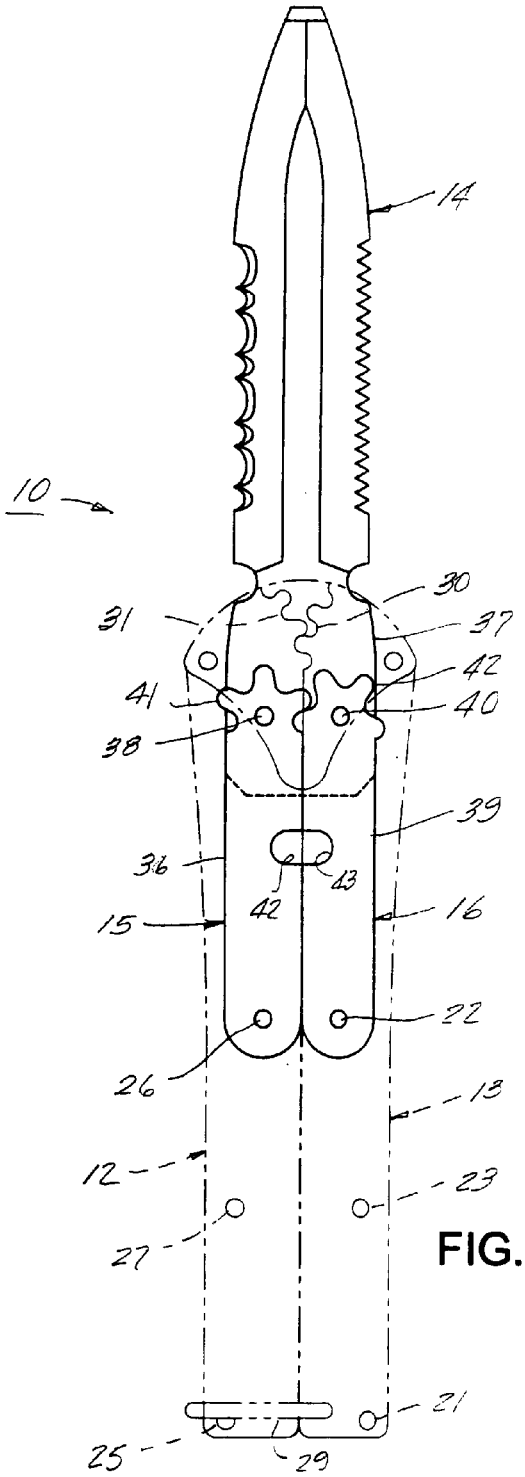
FIG. 3 is a view similar to the view shown in FIG. 1, illustrating the handle segments thereof in phantom lines.
Figure 4:
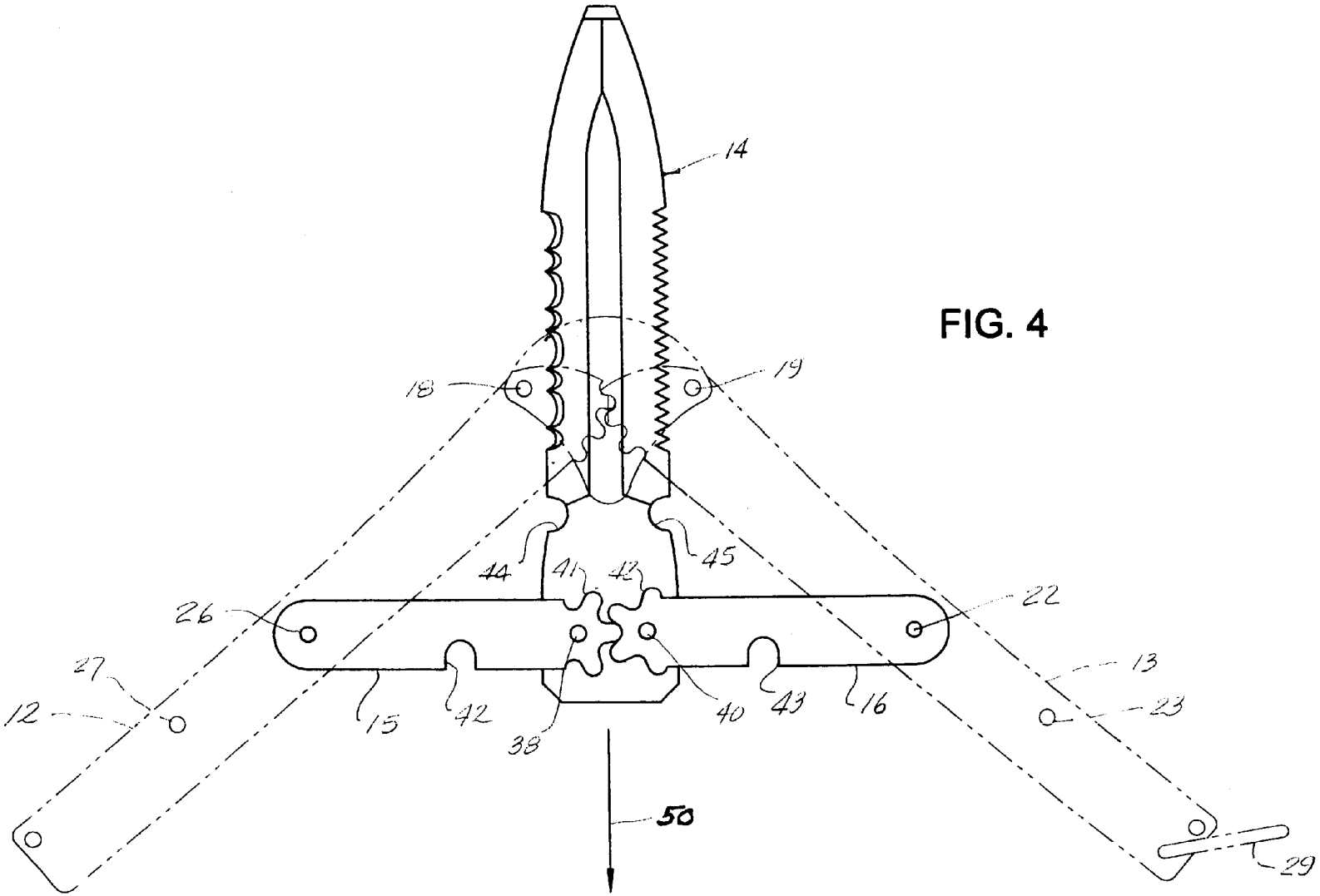
FIG. 4 is a view of the embodiment shown in FIG. 1, illustrating the handle segments in phantom lines, in positions intermediate the positions thereof shown in FIGS. 1 and 2.

As best seen in FIGS. 3 and 4, the end portions of handle plate sections 20, 20 and 24, 24 are provided with meshing gear sectors 30, 30 and 31, 31, respectively, which function to cause the handle segments to be disposed at the same angle relative to a line travel 50 of implement 14 when the handles are angularly displaced between such line of travel and their furthest angular displacement, as indicated by phantom lines in FIGS. 3 and 4.

Figure 5:
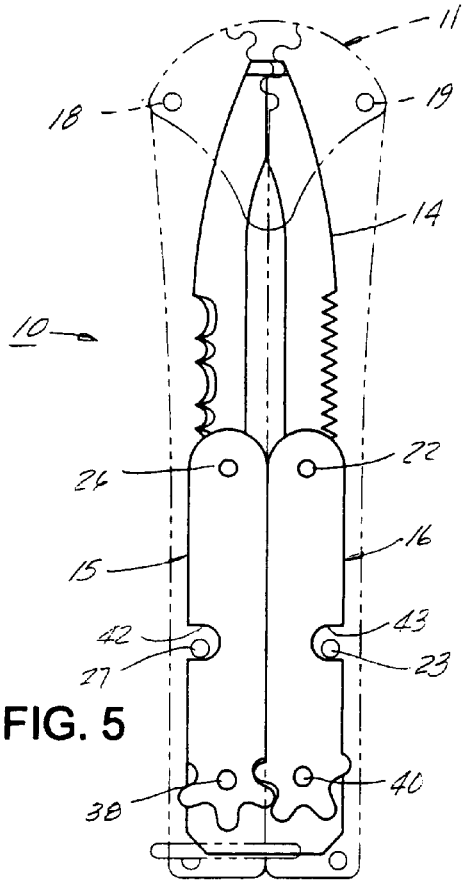
FIG. 5 is a view similar to the view shown in FIG. 2, illustrating the handle segments in phantom lines.

Implement 14 is adapted to be displaced along the aforementioned line of travel 50 passing between pivot pins 18 and 19, between an extended, operative position as shown in FIGS. 1 and 3, and a retracted, inoperative position as shown in FIG. 5, within the handle segments as shown in FIG. 2.

Figure 1A:
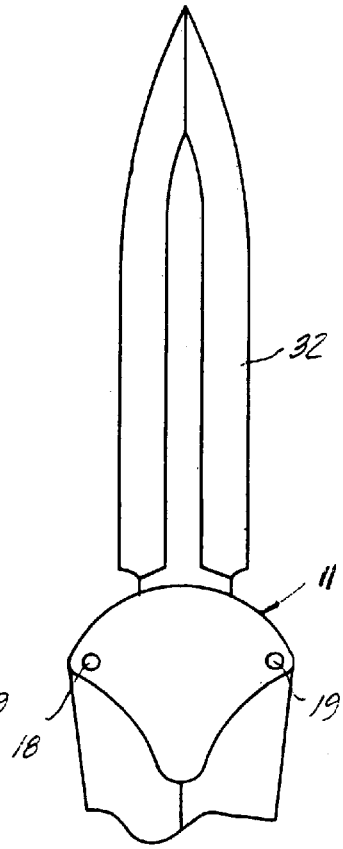
FIG. 1*a* is a side elevational view of a hand tool incorporating another embodiment of the invention which is similar to the embodiment shown in FIG. 1, provided with an alternate form of implement.

The implement may take any form such as a knife blade 32 as shown in FIG. 1A or may be formed with a serrated edge 33, a sawtooth edge 34 and/or a butt end 35 permitting the implement to function as a screwdriver. In addition to the configurations of the implement indicated, it may be provided with other configurations for performing various work functions.

Actuating links 15 and 16 are substantially identical in construction and function. As best illustrated in FIGS. 3 through 5, actuating link 15 consists of a pair of elongated plate sections 36, 36 spaced apart, having one set of ends pivotally connected to a shank portion 37 of the implement by means of a connecting pin 38, and an opposite set of ends pivotally connected to handle section 12 by means of connecting pin 26. Link 16 is similar to link 15 and consists of a pair of spaced apart, elongated plate sections 39, 39 having one set of ends pivotally connected to the shank portion of the implement by means of a connecting pin 40, and an opposite set of ends thereof pivotally connected to handle segment 13 by means of connecting pin 22. The ends of plate sections 36, 36 and 39, 39 connected to the shank portion of the implement are provided with meshing gear sectors as at 41 and 42, respectively, which causes links 15 and 16 to become angularly displaced at equal angles relative to the line of travel of the implement as such links are pivoted about connecting pins 38 and 40. The lengths and thicknesses of links 15 and 16 and their connections to handle segments 12 and 13 are such that when implement 14 is in its extended, operative position as shown in FIGS. 1 and 3 or in its retracted, inoperative position as shown in FIG. 5, the actuating links will be fully enclosed in the handle segments. Furthermore, the length of implement 14 is sized so that it also is fully enclosed within the handle segments when in the retracted, inoperative position also as shown in FIG. 5.

With the tool in a closed condition as shown in FIGS. 2 and 5, latch 29 securing the free ends of the handle segments together and implement 14 and actuating links 15 and 16 enclosed within the handle segments, the tool may be converted to its open condition as shown in FIGS. 1 and 3 with the implement in its extended operative position, the handle segments in their closed or collapsed condition in alignment with the implement and the actuating links enclosed within the handle segments, by releasing latch 29, gripping a handle segment with each hand and spreading them apart to positions as shown in FIG. 4, causing the actuating arms in the position as shown in FIG. 4 to pass over a dead center point, closing the handle segments by pivoting them toward each other to the positions shown in FIGS. 1 and 3 and then reattaching latch 29. When it is desired to close the tool, the procedure as described is essentially reversed. The latch is removed, the handles are gripped and moved apart to positions as illustrated in FIG. 4, the actuating links are nudged past the dead center position to permit the handle segments to be pivoted together, the handle segments are pivoted together and the latch is reattached.

Whether the tool is in the opened or closed condition, the actuating links will be enclosed entirely within the confines of the handle segments. With the tool in the closed position, both the implement and the actuating links will be enclosed within the confines of the handle segments.

It will be appreciated that by pivoting handle segments 12 and 13 toward and away from each other, actuating links 15 and 16 will cause implement 14 to displace along a line of travel 50, between its extended, operable position in alignment with the handle segments and its retracted, inoperative position enclosed by the handle sections. The handle segments and actuating links function as a linkage and cooperate as such linkage is expanded and collapsed to displace the implement between its open, operative position and its closed, inoperative position. The meshing gear sector portions of the handle sections and the actuating links further function to assure the displacement of the implement along the line of travel. When the actuating links are in their dead center position as shown in FIG. 4, the longitudinal center line of the implement will lie along its line of travel, each of the handle segments will be angularly displaced from the line of travel by substantially 45° and the actuating links will be disposed in longitudinal alignment, substantially at 90° to the center line.

As best shown in FIGS. 4 and 5, the plate sections of links 15 and 16 are provided with recesses 42, 42 and 43, 43 and the shank portion of implement 14 is provided with recesses 44 and 45 which are adapted to receive stop pins 27 and 23 when the tool is manipulated to its closed condition with the implement and actuating links received within the confines of the handle segments. In embodiments of the invention in which the handle segments are formed simply with recesses along their inner, adjoining edges and into which the implement and the actuating links would be received when the tool is in the closed condition, such stop pins and recesses in the implement and actuating links may be omitted.

As previously stated, implement 14 may be configured in any manner for use in providing a variety of work functions. The only requirement of such configuration is that its envelope be received within the confines of the handle segments when the tool is in the closed condition. Although the handle segments and actuating links have been described as sets of plate sections, it is contemplated within the scope of the present invention that such components may be formed of singular members. The components of the tool further may be formed of any materials, usually metallic materials, and may be configured to provide an aesthetic appearance as shown. The invention not only provides an effective tool which may be readily grasped and used when in the operative condition but one in which the implement may be conveniently enclosed in the handle when in the closed condition to permit the tool to be carried in pockets of the attire of the user.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A hand tool comprising:

a pair of handles operatively connected together for pivotal movement relative to each other about a first axis;

an implement displaceable along a line of travel, supported on said handles; and a pair of actuating links each having an end operatively connected to said implement for pivotal movement about a second axis and pivotally connected at another end thereof to a handle at a midpoint disposed between ends of said handle whereby upon pivoting said handles relative to each other about said first axis, said actuating links will be caused to displace said implement along said line of travel.

2. A tool according to claim 1 wherein said line of travel of said implement intersects said axes.

3. A hand tool according to claim 1 wherein said actuating links and portions of said handles function as a four bar linkage.

4. A hand tool according to claim 1 wherein said implement comprises a cutting blade.

5. A hand tool according to claim 1 wherein said implement comprises a saw blade.

6. A hand tool according to claim 5 wherein saw blade includes a sawtooth edge.

7. A hand tool according to claim 5 wherein said saw blade includes a serrated edge.

8. A hand tool according to claim 1 wherein said implement is displaceable along said line of travel between an extended, operative position disposed substantially beyond said first axis in a first direction and a retracted, inoperative position substantially beyond said first axis in a second direction opposite of said first direction.

9. A hand tool according to claim 8 wherein said implement is disposed in alignment with said handles when in said extended, operative position.

10. A hand tool according to claim 8 wherein said handles are provided with opposed openings and said implement is received within said openings when in said retracted, inoperative position.

11. A hand tool according to claim 10 wherein said actuating links are received within said openings when said implement is in either said retracted, operative or retracted, inoperative positions.

12. A hand tool according to claim 1 wherein each of said actuating links is pivotal relative to a connected handle about an arc of 180°.

13. A hand tool according to claim 12 wherein said handles are provided with opposed openings and each of said actuating links is received within the opening of a connected handle when said actuating link is pivoted near a beginning and an end of said arc.

14. A hand tool according to claim 1 including a dead center point of said actuating links defined by the intersection of said line of travel of said implement and a centerline of said actuating links disposed in longitudinal alignment, and wherein second axis is displaceable along said line of travel of said implement on opposite sides of said dead center point when said handles are angularly displaced relative to each other to displace said implement between said extended, operative and retracted, inoperative positions.

15. A hand tool according to claim 1 wherein a pair of ends of said handles operatively connected together are provided with meshing gear sectors.

16. A hand tool according to claim 1 wherein said ends of said actuating links operatively connected to said implement are provided with meshing gear sectors.

17. A hand tool according to claim 1 including means for detachably securing said handles in side by side relation when said handles are pivoted about said first axis to positions adjacent each other.

18. A hand tool according to claim 17 wherein said detachable securing means comprises a U-shaped latch pivotally connected to one of said handles, pivotal to receive an end of the other of said handles therein when said handles are disposed in side by side relation.

19. A hand tool comprising:

a base member;

an implement displaceable along a line of travel intersecting said base member;

a pair of handle segments each having an end pivotally connected to said base member to a side of line of travel; and a pair of actuating links each having an end pivotally connected to said implement and an opposite end pivotally connected to a handle segment at a midpoint disposed between ends of said connected handle segment whereby upon pivoting said handle segments about their pivotal connections to said base member, said actuating links will be caused to displace said implement along said line of travel.

20. A tool according to claim 19 wherein said base member includes means for guiding said implement, disposed along said line of travel.

21. A hand tool according to claim 20 wherein said guiding means comprises an opening through said base member disposed between the pivotal connections of said handle segments and said base member.

22. A hand tool according to claim 19 wherein said actuating links and portions of said handle segments function as a linkage.

23. A hand tool according to claim 19 wherein said implement comprises a cutting blade.

24. A hand tool according to claim 19 wherein said implement comprises a saw blade.

25. A hand tool according to claim 24 wherein said saw blade includes a sawtooth edge.

26. A hand tool according to claim 24 wherein said saw blade includes a serrated edge.

27. A hand tool according to claim 19 wherein said implement is displaceable along said line of travel between an extended, operative position disposed substantially beyond said base member in a first direction and a retracted, inoperative position substantially beyond said base member in a second direction opposite said first direction.

28. A hand tool according to claim 27 wherein said implement is disposed in substantially longitudinal alignment with said handle segments when in said extended, operative position.

29. A hand tool according to claim 27 wherein said handle segments are provided with opposed openings and said implement is received within said openings when in said retracted, inoperative position.

30. A hand tool according to claim 29 wherein said actuating links are received within said openings when said implement is in either said extended, operative position or said retracted, inoperative position.

31. A hand tool according to claim 19 wherein each of said actuating links is pivotal relative to a connected handle about an arc of 180°.

32. A hand tool according to claim 31 wherein said handles are provided with opposed openings and each of said actuating links is received within the opening of a connected handle when said actuating link is pivoted near a beginning and an end of said arc.

33. A hand tool according to claim 19 wherein a pair of ends of said handle segments pivotally connected to said base member are provided with meshing gear sectors.

34. A hand tool according to claim 19 wherein said ends of said actuating links pivotally connected to said implement are provided with meshing gear sectors.

35. A hand tool according to claim 19 including means for detachably securing said handle segments in side by side relation when said handles are pivoted about their pivotal connections with said base member to positions adjacent each other.

36. A hand tool according to claim 35 wherein said detachable securing means comprises a latch having a U-shaped configuration pivotally connected to one of said handle segments and pivotal to receive an end of the other of said handle segments therein when said handle segments are disposed in side by side relation.

* * * * *